United States Patent [19]

Morano et al.

[11] Patent Number: 4,583,112

[45] Date of Patent: Apr. 15, 1986

[54] VENTING SYSTEM FOR THE DEVELOPER HOUSING OF AN ELECTROSTATIC COPYING MACHINE

[75] Inventors: Richard A. Morano, Lyons; Edward P. deJong, Webster; Jeanne K. Elliott, Rochester, all of N.Y.

[73] Assignee: Xerox Corporation, Stamford, Conn.

[21] Appl. No.: 665,820

[22] Filed: Oct. 29, 1984

[51] Int. Cl.[4] ..... G03G 15/08

[52] U.S. Cl. ..... 355/3 DD; 355/14 D; 355/15

[58] Field of Search ..... 355/3 DD, 14 D, 15, 355/10; 209/54, 19, 20, 21; 55/397, 154, 394

[56] References Cited

U.S. PATENT DOCUMENTS

| | | | |
|---|---|---|---|
| 1,519,541 | 12/1924 | Johnson | 55/397 |
| 2,551,582 | 5/1951 | Carlson | 101/426 |
| 2,603,309 | 7/1952 | Mercier et al. | 55/397 X |
| 3,425,193 | 2/1969 | Emmerson | 55/385 |
| 3,598,486 | 8/1971 | Kushima | 355/10 |
| 3,611,905 | 10/1971 | Brinks et al. | 98/6 |
| 3,685,534 | 8/1972 | Straitz | 137/171 |
| 3,775,948 | 12/1973 | Beam | 55/397 X |
| 3,909,864 | 10/1975 | Tanaka et al. | 355/15 X |
| 4,168,901 | 9/1979 | Ito et al. | 355/3 DD |
| 4,175,937 | 11/1979 | Brandau et al. | 55/419 |
| 4,361,396 | 11/1982 | Uchida | 355/15 |

FOREIGN PATENT DOCUMENTS 2120471 7/1972 France .

OTHER PUBLICATIONS

Bickmore, "Toner Emission Control Concept", *Xerox Disclosure Jrnl.*, vol. 1, No. 4, Apr., 1976.

Jugle et al., "Improved Filter Apparatus", *Xerox Disclosure Jrnl.*, vol. 2, No. 2, Mar./Apr., 1977.

Jugle et al., "Improved Emission Controller for Development Apparatus", *Xerox Disclosure Jrnl.*, vol. 2, No. 2, Mar./Apr., 1977.

Horak et al., "Toner Filtering and Containment System", *Xerox Disclosure Jrnl.*, vol. 1, Nos. 11/12, Nov./-Dec., 1976.

*Primary Examiner*—A. C. Prescott

*Attorney, Agent, or Firm*—Frederick E. Mullen

[57] ABSTRACT

Means for venting the interior of the developer housing in a xerographic type copying or printing machine to control pressures therein comprising, a cover sealingly attached over a portion of the developer housing exterior and cooperative therewith to form an elongated relatively shallow exhaust chamber substantially coextensive with the developer housing, an exhaust port in the developer housing adjacent each end communicating the interior of the developer housing with the exhaust chamber, a discharge opening in the cover adjacent the center thereof, and filter means for trapping toner in the discharge opening; pressure air from the interior of the developer housing discharging through the exhaust ports and exhaust chamber to the discharge opening and the exterior, the sharp bends imposed on the air stream passing into, through, and out of the exhaust chamber causing toner entrained with the air stream to be separated from the air stream and deposited within the chamber for later removal. In an alternate embodiment, a series of baffles are provided within the exhaust chamber astride the path of the air creating a tortuous path and enhancing further separation of toner entrained with the air stream.

5 Claims, 3 Drawing Figures

VENTING SYSTEM FOR THE DEVELOPER HOUSING OF AN ELECTROSTATIC COPYING MACHINE

The invention relates to the developing system of a xerographic printing and copying machine, and more particularly, to an arrangement for venting the developing system housing to control pressures in the housing and the tendency for toner to leak from the housing.

Xerographic type printing or copying machines employ a movable member, usually in the form of a belt or drum, having a photoconductive surface on which latent electrostatic images are created through exposure, the photoconductive surface having been previously charged for this purpose. Following exposure, the latent electrostatic image is developed by the machine developing system with a suitable developer which typically comprises a mixture of toner and carrier. Following developing, the developed image is transferred to a suitable copy substrate material such as a copy sheet while the photoconductive member is cleaned and the process repeated. The transferred image is fused or fixed to render the copy permanent.

Typically, modern day developing systems employ at least one magnetic brush disposed in a developer housing, the lower portion of the developer housing serving as a sump for a supply of developer. Usually one or more devices such as a paddle wheel are provided for loading developer from the sump onto the magnetic brush with unused developer being returned to the sump by the magnetic brush. And, as toner is used up, fresh toner is supplied by a automatic toner dispensing system.

In xerographic type copying and printing machines of the type alluded to, highly effective ways of sealing the operating junctions between the moving photoconductive surface and the component parts of the developing system have been developed. However, one unfortunate result of this enhanced sealing has been an increase in the internal operating pressures within the developer housing. This increase in internal developer housing pressure, which is traceable principally to the rotating photoreceptor and the resulting laminar flow that is directed into the developer housing by the developer brush, has tended to increase machine contamination due to toner being forced by pressures in the developer housing through any of the numerous operating openings that exist in the developer housing and into the adjoining parts of the machine. Such toner leakage presents a problem because the toner can cause increased wear on the moving parts of the machine and because the accumulated toner dust and dirt will stain and dirty anyone who contacts the machine.

The invention is intended to reduce pressures within the developer housing of the developing system of a xerographic type copying or printing machine without the need or use of auxiliary pumps, vacuum devices and the like to in turn reduce the leakage of toner from the developer housing, comprising in combination: a cover disposable over a section of the developer housing exterior and cooperating therewith to form an elongated shallow exhaust chamber; at least one inlet port communicating the interior of the developer housing with the exhaust chamber; at least one exhaust port communicating the exhaust chamber with a point outside of the chamber; the inlet port and the exhaust port being spaced apart from one another along the axis of the exhaust chamber to form a relatively long passageway for the flow of pressure air from the interior of the developer housing and out through the exhaust chamber, the relatively abrupt changes in direction resulting from the displacement of the inlet and exhaust ports from one another coupled with the reduced height of the exhaust chamber and the expanding air passageway causing toner entrained with the air to be separated from the air and to deposit in the exhaust chamber for subsequent removal.

The invention further relates to a method for controlling pressure in the developer housing of a copying or printing machine to reduce the leakage of toner from the housing interior and contamination of adjoining areas of the machine, comprising the steps of: bleeding pressure air from the interior of the developer housing around at least one relatively sharp bend into a relatively long shallow chamber to cause toner entrained with the pressure air to be separated out and be trapped in the chamber; passing the pressure air laterally along the chamber over a predetermined distance; discharging the pressure air from the chamber; and filtering the pressure air as the pressure air is discharged from the chamber to prevent the escape of toner from the chamber.

IN THE DRAWINGS

Figure 1:
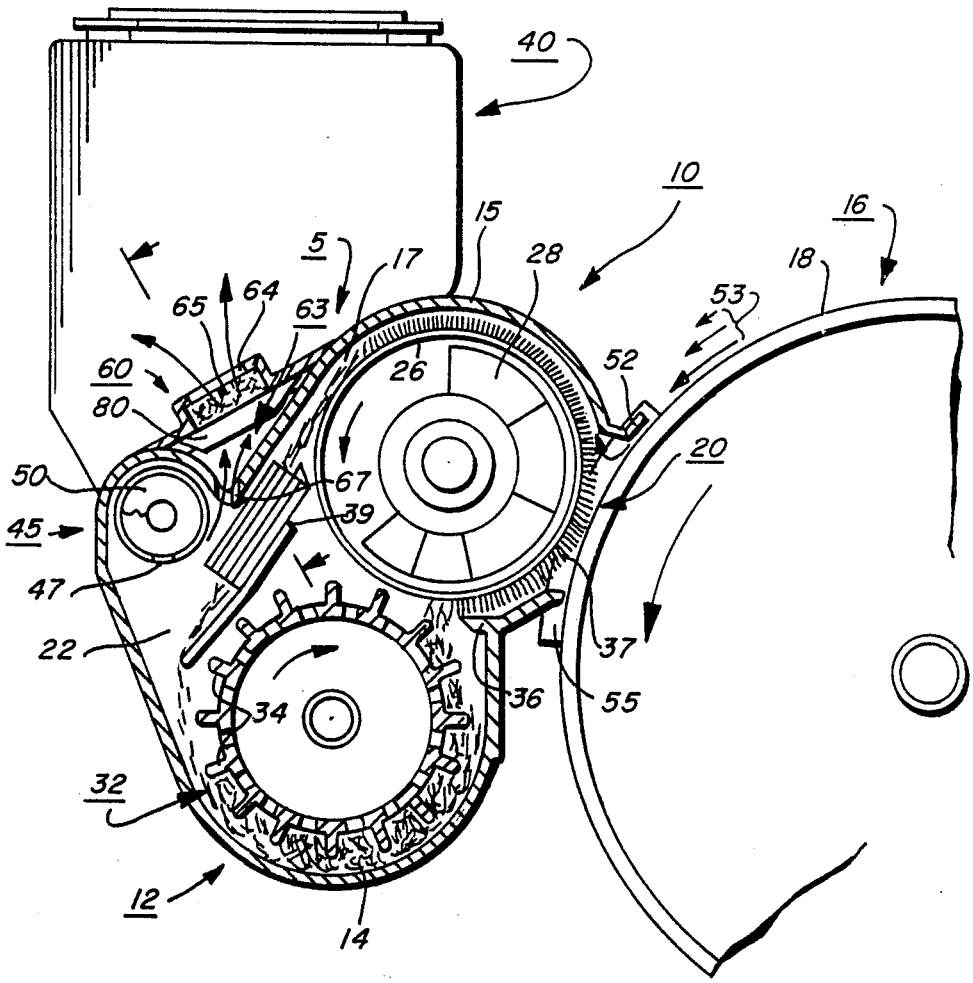
FIG. 1 is a plan view showing details of a developing system incorporating the developer housing venting arrangement of the present invention.

Referring to the drawings, there is shown a developing system, designated generally by the numeral 10, of an exemplary xerographic type copying or reproduction machine incorporating the developer housing venting arrangement 5 of the present invention. Developing system 10 includes a developer housing 12 having a sump 14 within which a developer, typically composed of relatively larger carrier beads and relatively smaller ink particles or toner, resides. Developer housing 12 is suitably supported in predetermined operative relation with the machine photoconductive member, exemplified by a drum 16 having a photoconductive surface 18. Drum 16 is rotated in the direction shown by the solid line arrow in FIG. 1 by suitable drive means (not shown).

As will be understood by those skilled in the xerographic arts, during operation of the copying or reproduction machine, the photoconductive surface 18 of drum 16 is uniformly charged and thereafter exposed to create a latent electrostatic image on the photoconductive surface 18. The latent electrostatic image is thereafter carried on drum 16 past developing system 10 where the image is developed, the developed image being thereafter transferred to a copy sheet brought forward from a suitable copy sheet supply in registered relation with the developed image. The unfused image is thereafter fixed or fused to provide a permanent copy. Following transfer, the photoconductive surface 18 of drum 16 is cleaned to remove any leftover developer materials preparatory to charging.

A magnetic brush type developing roll 20 is rotatably journaled in the sides 22 of developer housing 12 in predetermined operative relation with the photoconductive surface 18 of drum 16, the axis of developing roll 20 being parallel to the the axis of rotation of drum 16. Developing roll 10 has an outer rotatable hollow sleeve or cylinder 26 of a suitable non-magnetic material such as aluminum having a stationary array of magnets 28 disposed therewithin, the polarity and angular disposition of magnets 28 being chosen to cause developer to be attracted to the surface of sleeve 26 and carried thereon into developing relation with the photoconductive surface 18.

A cylindrical paddle wheel 32 having a plurality of vanes or paddles 34 about the periphery is rotatably journaled in sides 22 of developer housing 12 below developing roll 20, the paths of rotation of sleeve 26 of developing roll 20 and paddle wheel 32 being in closely spaced relation with one another. The axis of paddle wheel 32 is parallel with the axis of drum 16 and developing roll 20. Paddle wheel 32 is located in developer housing 12 such that paddles 24 pass or sweep through sump 14 and the developer therein to carry developer therefrom into proximity with sleeve 26 of developing roll 20, the magnetic force produced by magnets 28 attracting developer carried by paddles 34 to the outer surface of sleeve 26 to load developer onto the developing roll sleeve 26.

A bar-like wiper 36 is formed on developer housing 12 downstream of the point where developer is loaded onto developing roll sleeve 26, the leading edge of wiper 34 being in predetermined spaced relation with the surface of sleeve 26 to remove excess developer and provide a brush-like covering 37 of developer of preset thickness on sleeve 26. Developing roll 20 and paddle wheel 32 are rotated by suitable means (not shown) in the direction shown by the solid line arrows in FIG. 1.

The developer brush 37 created on the surface of sleeve 26 of developing roll 20 is brought into developing relation with the photoconductive surface 18 of drum 16 to develop the latent electrostatic image on the drum surface 18. With continued rotation of sleeve 26, the developer is carried away from drum 16 so that, as the developer supporting area of sleeve 26 comes opposite the point of no magnetic force, the developer falls by gravity back into sump 14. A suitable cross-mixing baffle 39 extends across the width of developer housing 12 in the path of the returning developer, baffle 39 serving to intermix the carrier and toner particles to assure a uniform developer mixture in sump 14.

Toner is re-supplied to developer housing 12 from a toner dispensing hopper 40 disposed on one side of developer housing 12. An auger type agitator (not shown) in the bottom of hopper 40 forces toner from the hopper and into a hollow toner dispensing tube 45 which extends transversely across the width of housing 12. Dispensing tube 45 has a succession of toner discharge openings or apertures 47 therein which allow metered amounts of toner in tube 45 to pass into sump 14. A rotatable toner transporting auger 50 extends through the interior of dispensing tube 45, auger 50 when rotated supplying toner from hopper 40 to toner dispensing tube 45 for discharge into developer housing 12. Auger 50 is rotated by suitable drive means (not shown) periodically on a demand for toner.

To reduce the escape of toner from housing 12 into other areas of the machine, the upper lip of developer housing 12 incorporates a magnetic seal 52 extending lengthwise across the developer housing and in closely spaced relation with the photoconductive surface 18 of drum 16. Additionally, foam seals 55 are provided at the ends of developer housing 12 to seal the area between the developer housing sides 22 and the drum 16.

During operation of machine 10, the laminar flow (represented by the arrows 53 in FIG. 1 of the drawings) created by rotation of drum 16 is accommodated by deliberately exhausting air into developer housing 12 through magnetic brush roll 20, the rotating magnetic brush roll acting in a manner similiar to a fan to carry the air into housing 12. With developer housing 12 effectively sealed, a relatively high positive pressure is developed within housing 12 which can cause the relatively dirty toner to be blown out various small holes in the developer housing (typically shaft openings and housing joints) and into adjoining areas of the machine, dirtying and contaminating the machine components and covers. This can lead to deteriorated copy quality, reduced life of the machine components, and perhaps most significant to the user or operator, to an unsightly and dirty machine and staining and dirtying of the operator's hands and clothes when using or servicing the machine.

Figure 2:
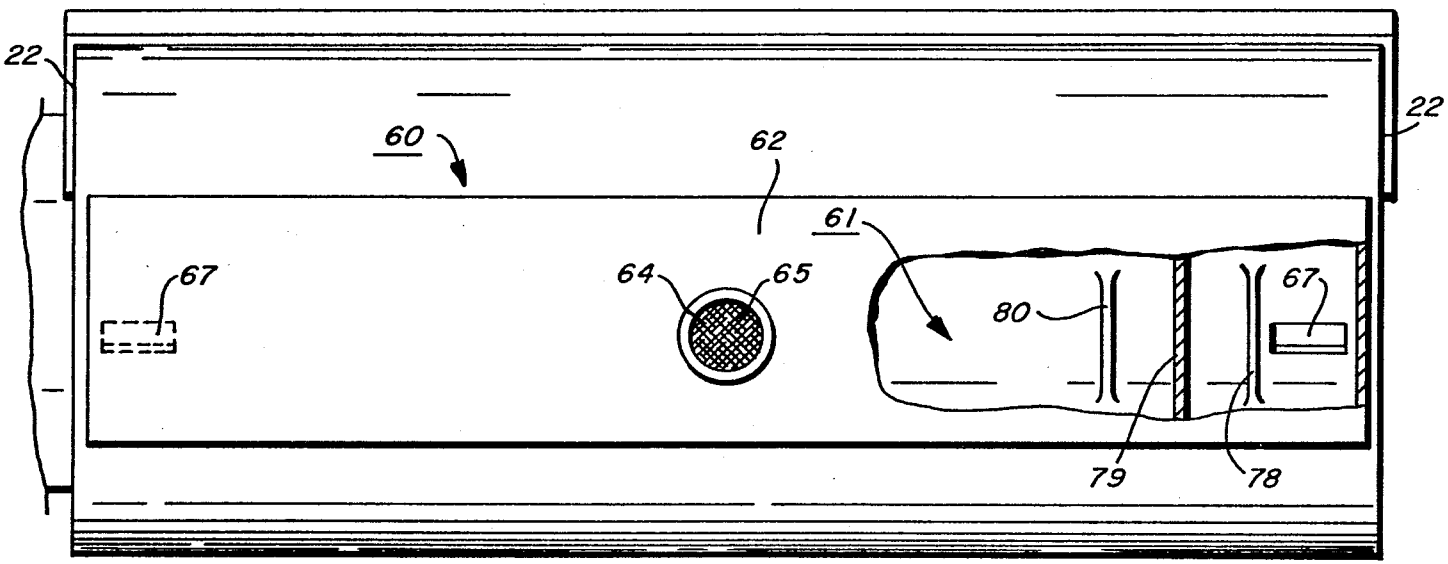
FIG. 2 is a top view partially in section of the developer housing venting arrangement illustrating details of the mechanism for exhausting pressure air from the developer housing while separating toner entrapped with the air to prevent discharge thereof.
Figure 3:
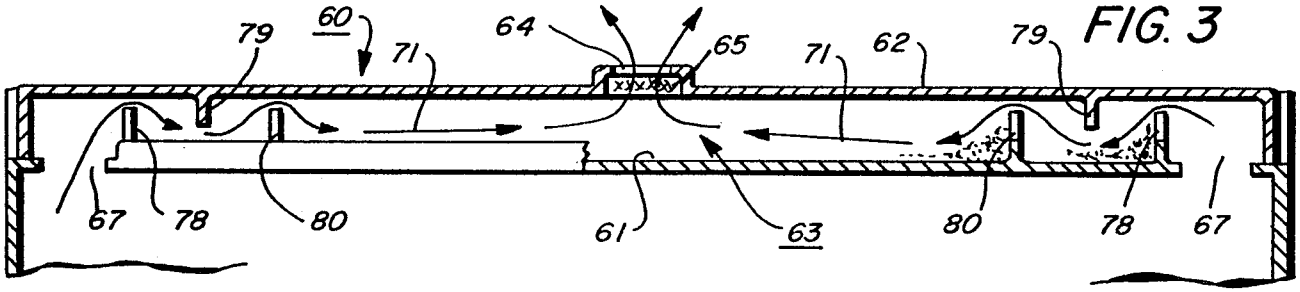
FIG. 3 is a side view of the pressure air exhausting and toner separating mechanism shown in FIG. 3.

Referring now to FIGS. 1, 2 and 3 of the drawings, the developer housing venting arrangement 5, which is intended to reduce and control pressures in developer housing 12, comprises a removable cover assembly 60 spacedly positioned over a section 61 of the outside of developer housing 12. Cover assembly 60, which is secured to housing 12 by suitable releasable attaching means (not shown), forms, in cooperation with the portion 61 of housing 12, an elongated, relatively shallow, sealed exhaust chamber 63. The section 61 of the exterior of developer housing 12 encased by cover assembly 60 forms the floor or base of exhaust chamber 63. Cover assembly 60 includes a cover 62 having a central exhaust port 64 for exhausting pressure air from chamber 64. A filter 65 of suitable filter material is disposed in the exhaust port 64 to capture any toner particles borne by the air and prevent the discharge of toner with the air being exhausted through port 64 into a selected machine area and/or the atmosphere.

A pair of vent openings 67 are provided in the floor 61 of developer housing 12, vent openings 67 communicating the interior of housing 12 with the exhaust chamber 63. Vent openings 67 are located proximate the ends of developer housing 12 so that a relatively long path 71 is established for the movement of air from the interior of housing 12 through chamber 63 to exhaust port 64. Preferably, a plurality of spaced baffles 78, 79, 80 are provided in exhaust chamber 63 astride the path 71, baffles 78, 79, 80 cooperating with one another and with the adjoining walls of exhaust chamber 63 to form a relatively tortuous path for the air as the air passes from vent openings 67 through chamber 63 to exhaust port 64.

OPERATION

In operation of the developer housing venting arrangement 5, the build up of pressure that occurs in developer housing 12 is relieved by the bleed of pressure air from the interior of developer housing 12 through vent openings 67 into exhaust chamber 63 and from exhaust chamber 63 out through exhaust opening 64. Toner entrapped in the stream of pressure air is separated from the air as a result of the circuitous path imposed on the stream of air and deposited onto the base or floor 61 of exhaust chamber 63. In this context, it will be understood that the sharp, abrupt changes in direction of the air stream as the air passes from vent openings 67 into the relatively shallow exhaust chamber 63 and from chamber 63 to exhaust opening 64 cause the toner to separate from the air stream and drop down onto the exhaust chamber floor 61. From there, the accumulated toner may be removed from time to time as when the machine is undergoing service.

Any toner remaining in the air stream and carried to exhaust opening 64 is trapped and removed by filter 65 prior to discharge. Baffles 78, 79, 80, where employed, increase the number of abrupt directional changes imposed on the stream of pressure air and further enhance separation of toner entrained in the air stream out onto the floor 61 of exhaust chamber 63. As a result, the interior of developer housing 12 is vented to the atmosphere reducing pressure build up within the housing 12 and the tendency for toner to be blown or leak into adjoining areas of the machine. As will be understood, diffusing the air pressure allows the velocity of the air stream to drop, causing stall areas that allow toner to settle out. As a result, toner entrained with the air being exhausted is effectively separated out and collected in the exhaust chamber 63 for later removal.

Servicing and/or cleaning of the aforedescribed venting arrangement in the field may be done periodically by the machine Tech Rep. For this purpose, cover assembly 60 is removed and any toner accumulated on the developer housing 12 cleaned away. Cover assembly 60 including filter 65 may also be cleaned and/or replaced at that time.

While the invention has been described with reference to the structure disclosed, it is not confined to the details set forth, but is intended to cover such modifications or changes as may come within the scope of the following claims.

We claim:

1. Means for bleeding pressure air from the developer housing within a xerographic copying or printing machine to reduce pressure in said housing, and prevent pressure build up in said housing during operation of said machine from driving toner from said housing into adjoining areas of the machine without the use of auxiliary air moving means, comprising in combination:

(a) a cover encasing a portion of the outer wall of said developer housing to form in cooperation with said developer housing wall an elongated shallow exhaust chamber for said pressure air;

(b) at least one inlet port communicating the interior of said developer housing with said exhaust chamber; and (c) at least one exhaust port communicating said exhaust chamber with a point exterior of said exhaust chamber, said inlet and outlet ports being spaced apart from one another along the axis of said exhaust chamber to form a relatively long passageway for the flow of pressure air entering said inlet port from the interior of said developer housing through said exhaust chamber to said exhaust port and the exterior of said chamber to reduce pressure in said housing, the relatively abrupt changes in direction caused by the reduced height of said exhaust chamber and the relatively long separation between said inlet port and said exhaust port causing any toner that may be entrained with said pressure air as said pressure air is being bled from said housing to be separated from said pressure air and to be deposited in said exhaust chamber whereby to prevent exhausting of toner with said pressure air into said adjoining areas of said machine.

2. The means according to claim 1 including baffle means interposed athwart said passageway, said baffle means causing said pressure air to follow a tortuous path as said pressure air flows through said passageway to said exhaust opening whereby to enhance separation of toner entrained in said air stream.

3. In a xerographic copying or printing machine, the combination of:

(a) a photoconductive member in said machine on which latent electrostatic images are formed;

(b) developer means in said machine in operative relation with said photoconductive member for developing the latent images formed on said photoconductive member, said developing means including (1) a developer housing having a sump for holding a supply of developer including toner, and (2) means to bring developer from said sump into developing relation with said photoconductive member, (c) sealing means for sealing said developer housing against the escape of toner to adjoining areas of said machine; and (d) means for reducing pressures in said developer housing to prevent excess pressure created in said developer housing during operation of said machine from driving toner through said sealing means into said other adjoining areas of said machine including (1) means forming a relatively narrow chamber of reduced height adjacent to and substantially coextensive with said developer housing;

(2) a pair of exhaust ports communicating the interior of said developer housing with said chamber, said exhaust ports being adjacent opposite ends of said chamber; and (3) a discharge opening in said chamber communicating said chamber with an area of said machine exterior of said developer housing, said discharge opening being substantially midway between the ends of said chamber so that there is provided a pair of relatively long passageways in said chamber for the movement of pressure air from the interior of said developer housing through said exhaust ports to said discharge opening to reduce pressure in said developer housing, the substantially right angle bends created as said pressure air passes through said exhaust ports into said chamber and from said chamber into said discharge opening causing any toner particles that are entrained with said air stream to be separated from said air stream and deposited in said chamber thereby preventing discharge of toner particles with said air stream into said machine area.

4. The machine according to claim 3 including a series of gates disposed in each of said passageways between said exhaust ports and said discharge opening, said gates creating a relatively tortuous path for the movement of pressure air along said passageways in said chamber whereby to enhance separation of any toner particles that are entrained with said pressure air.

5. The machine according to claim 4 including filter means in said discharge opening to remove any remaining toner particles that are entrained with said pressure air whereby to prevent discharge of toner particles with said air stream into said machine area.

* * * * *